US006077114A

United States Patent [19]

Lu

[11] Patent Number: 6,077,114

[45] Date of Patent: Jun. 20, 2000

[54] ELECTRIC CONNECTOR SET

[75] Inventor: Lien-Wan Lu, Tao-Yuan Hsien, Taiwan

[73] Assignee: Fullcom Technology Corporation, Tao-Yuan Hsien, Taiwan

[21] Appl. No.: 09/264,534

[22] Filed: Mar. 8, 1999

[51] Int. Cl.[7] ..... H01R 13/73

[52] U.S. Cl. ..... 439/541.5

[58] Field of Search ..... 439/541.5, 540.1, 439/79

[56] References Cited

U.S. PATENT DOCUMENTS 5,167,531 12/1992 Broschard, III et al. ..... 439/541.5
5,336,109 8/1994 Hillbish et al. ..... 439/541.5
5,613,875 3/1997 Yang ..... 439/541.5
5,695,362 12/1997 Hillbish et al. ..... 439/541.5

*Primary Examiner*—Gary F. Paumen

[57] ABSTRACT

An electric connector structure is disclosed. The frame body thereof is integrally formed with a vertical plate and a horizontal plate which are connected with each other, and the aforementioned connector with a plurality of terminal inserting holes is formed integrally on the horizontal plate, place of the connection of horizontal plate and the vertical plate is installed with connector mounting hole, the connector mounting hole is used to mount the second connector. A notch for mounting the first connector and cause the terminal pins on the first connector is inserted into these inserting holes. Thus, the error induced from assembly is prevented.

6 Claims, 6 Drawing Sheets

ELECTRIC CONNECTOR SET

FIELD OF THE INVENTION

The present invention relates to an electric connector set including three connectors, wherein each of the connectors in the connector set and the frame body are integrally combined so that the structure of the frame body is simplified, the whole manufacturing procedure can be reduced and the manufacturing cost is decreased.

BACKGROUND OF THE INVENTION

The conducting wires are used to communicate the computer mainframe and the peripheral devices. The conducting wires and peripheral devices are connected by electric connectors. Therefore, the ends of the computer motherboards and the interface cards are mounted with electric connectors. While connectors are connected on the two ends of each conducting wire. Thereby, the male (female) connectors can be inserted into the female (male) electric connectors so that two devices are connected by the conducting wires.

The prior art electric structure shown in FIG. 6 includes a frame body A, an inserting base B, a first connector C, and a second connector D. The frame body A has a L shape and buckling portions A1 are projected from the two sides of the horizontal plate. A plurality of inserting hole B1 for being inserted by the terminal pins of first and second connectors. Hooks B2 are installed on the two sides of the connector B. The terminal pins of the second connector D are inserted into a part of the terminal pins B1 of the inserting base B and then the hooks B2 of the inserting base B are buckled to the buckling portion A1 of the frame body A so that the inserting base B is combined with the horizontal plate of L shape in the frame body A. While the first inserting base C is fixedly installed with the vertical plate of the frame body A and the terminal pins thereof are inserted into the other connectors on the inserting base B. Thus, a complete electric connector is integrated.

However, in the aforementioned prior art electric connector, the frame body A and the inserting base B are independent bodies before assembling. Thus, in manufacturing, at least two independent modules are necessary. Thus, the manufacturing process is complex, and the costs in labors are large and time required is long. Therefore, it is desired to have a novel design of an electric connectors without any aforementioned disadvantages.

SUMMARY OF THE INVENTION

Therefore, the primary object of the present invention is to provide an electric connector structure, wherein the connector and the frame body are integrally combined so that the whole manufacturing procedure can be reduced and the manufacturing cost is reduced.

Accordingly, an electric connector structure is disclosed in the present invention. The frame body thereof is integrally formed with a vertical plate and a horizontal plate which are connected with each others, and the aforementioned connector with a plurality of terminal inserting holes is formed integrally on the horizontal plate. The connection of horizontal plate and the vertical plate is installed with connector mounting hole, the connector mounting hole is used to mount the second connector. A notch for mounting the first connector and cause the terminal pins on the first connector is inserted into these inserting holes. The error induced from assembly is prevented.

The various objects and advantages of the present invention will be more readily understood from the following detailed description when read in conjunction with the appended drawing.

DETAILED DESCRIPTION OF THE PREFERRED EMBODIMENTS

Figure 1:
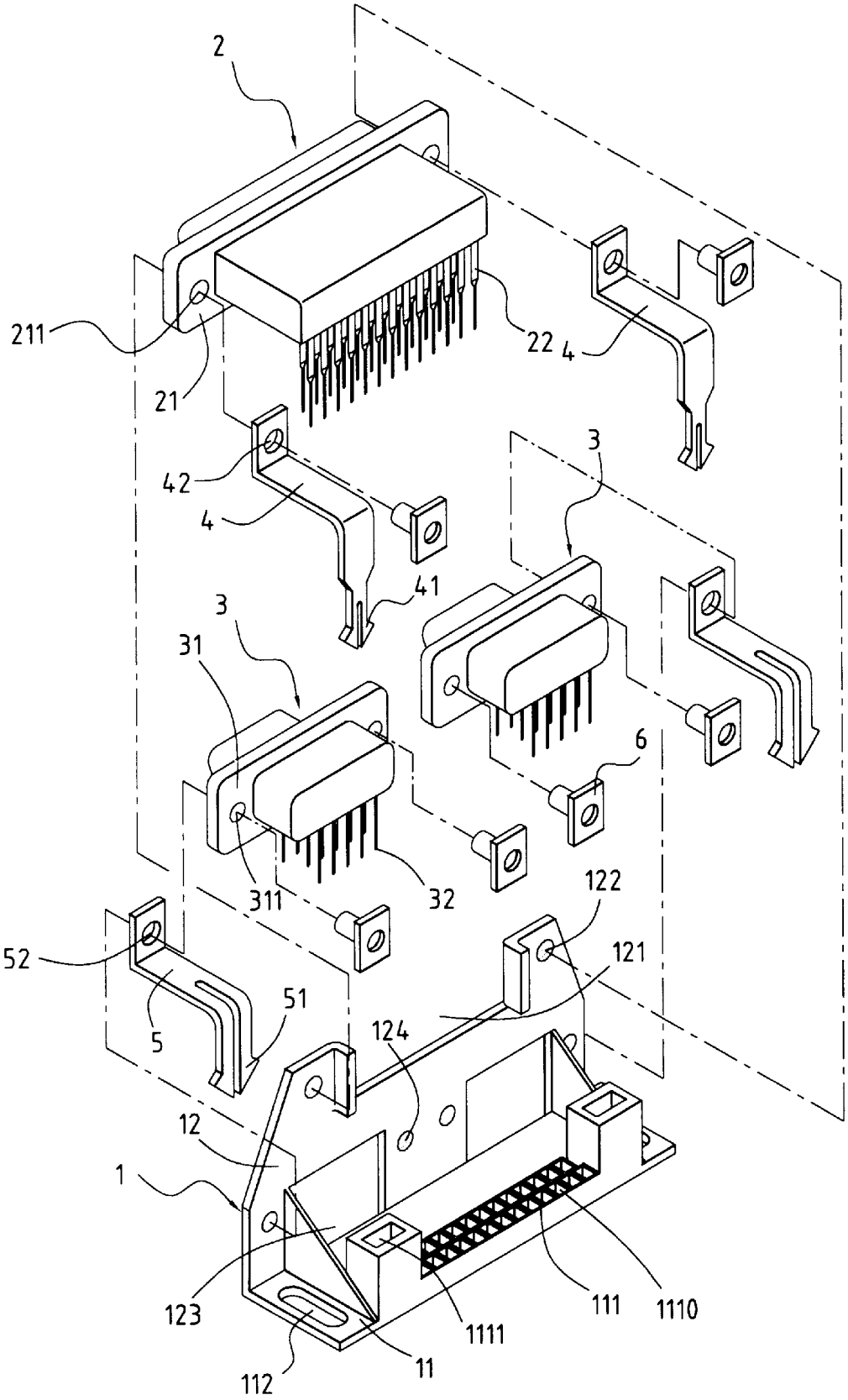
FIG. 1 is a perspective view showing that the assembled relation of components in the present invention.
Figure 2:
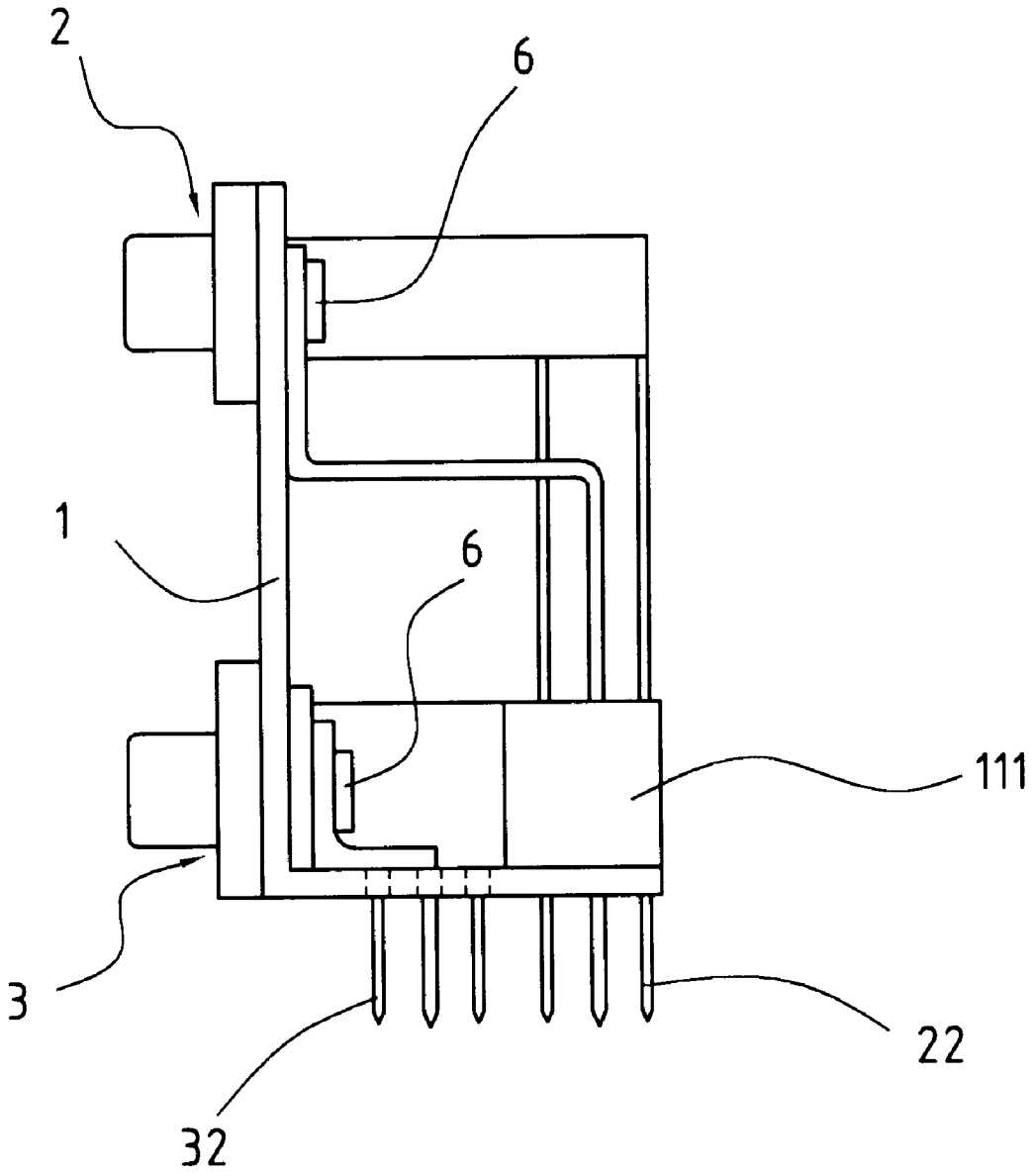
FIG. 2 is a perspective view showing an assembled structure of the present invention.
Figure 3:
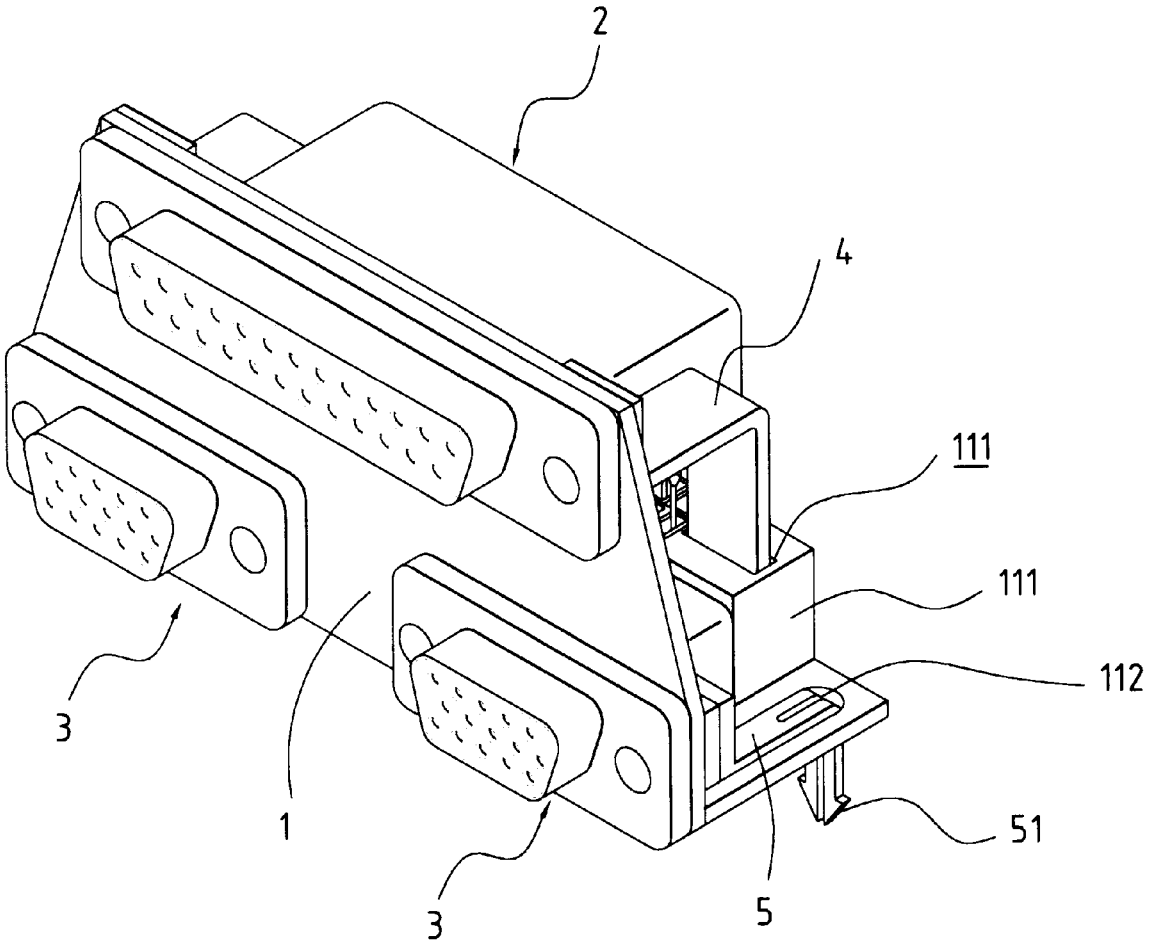
FIG. 3 is a side plane view of FIG. 2.

With reference now to FIG. 1, the electric connector set of the present invention comprises a frame body 1, a first connector 2 and two second connectors 3. The frame body 1 has a vertical plate 12 and a horizontal plate 11 which are formed integrally as a L shape. An inserting seat 111 of a plurality of terminal inserting hole 1110 is integrally formed on the horizontal plate 11, two opposite sides of the inserting base 111 are installed with respective inserting holes 1111. Moreover, each of sides of the horizontal plate 11 is formed with a through hole 112. Another, two connector mounting holes 123 are installed on the vertical plate 12. A notch 121 is formed on the upper edge of the vertical plate 12. Each side of the vertical plate 12 with respect to the notch 121 is formed with a first pin hole 122. A second pin hole 124 is formed on the side of the vertical plate 12 with respect to the connector mounting hole 123. The first connector 2 has a plate body 21 with holes 211 on the two sides thereof. A plurality of terminal pins 22 are formed vertically on the plate 21 so that the plate body 21 of the first connector 2 can be inserted into the notch 121 of the frame body 1 and cause the terminal pins 22 is inserted into the terminal inserting holes 1110. The holes 211 of the first connector 2 are correspondent to the second pin holes 122 of the vertical plate 12. In the present invention, independent first elastic bent pieces 4 and second elastic bent pieces 5 are further provided. The first and the second elastic bent pieces 4 and 5 are bent as an "ㄴ" shape and the vertical portions on the upper portions of the elastic bent pieces are shorter, while the vertical portions on the lower edge of the elastic bent pieces are longer. The upper vertical portions of the first and the second elastic bent pieces 4 and 5 are installed with respective through holes 42 and 52. While a vertical slot is formed on the lower end of the lower vertical portion of the first elastic bent piece 4 and hook portions 41 are formed on the two respective sides of the lower end of the lower vertical portions so that the hooks 41 has a transversal elasticity. A vertical slot extended to a horizontal surface is formed on the lower end of the lower vertical portion of the first elastic bent piece 5 and hook portions 51 are formed on the two respective sides of the lower end of the lower vertical portions so that the hooks 51 has a transversal elasticity. Before assembling the connector 2 into the frame body 1, a rivet 6 is firstly penetrated through the through hole 42 of the first elastic bent piece 4 and the hole 211 of the first connector 2. Then, the lower vertical portion of the first vertical portion 4 is penetrated through the inserting hole 1111 of the frame body 1. Next, the plate body 21 of the first connector 2 will be inserted into the notch 121 and the rivet 6 is fixed on the second pin hole 122. The second connector 3 has a plate body 31 with holes 311 of the two sides thereof. The plate body 31 is combined with a plurality of terminal pins 32. Before the second connector 3 is combined with the frame body 1, the lower vertical portion of the second elastic bent piece 5 is firstly penetrated through the slot 112 to cause the through hole 52 is correspondent to the second pin hole 124. Then the second connector 3 is inserted into the connector mounting hole 123 of the frame body 1 and the terminal pins 32 are penetrated through the holes of the horizontal plate 11 so to have the came orientation as that of the terminal pins 22. Another, the hole 311 of the second connector 3 is correspondent to the through hole 52 and the second pin 124. Next, a rivet 6 penetrates through the hole 311, through hole 52 and second pinhole 124. Therefore, an electric connector is formed (as shown in FIG. 3). While lower vertical portions of the first and second elastic bent pieces 4 and 5 extended from the frame body 1 can be inserted into the fixing element of a computer, and it is fixed by hook 41 and 51. By this kind of design, since the frame body 1 and the inserting base 111 are formed integrally, thus, only one mold is necessary. Therefore, the manufacturing process is simplified and the cost is reduced. Moreover, the error inducing from assembling is reduced.

Figure 4:
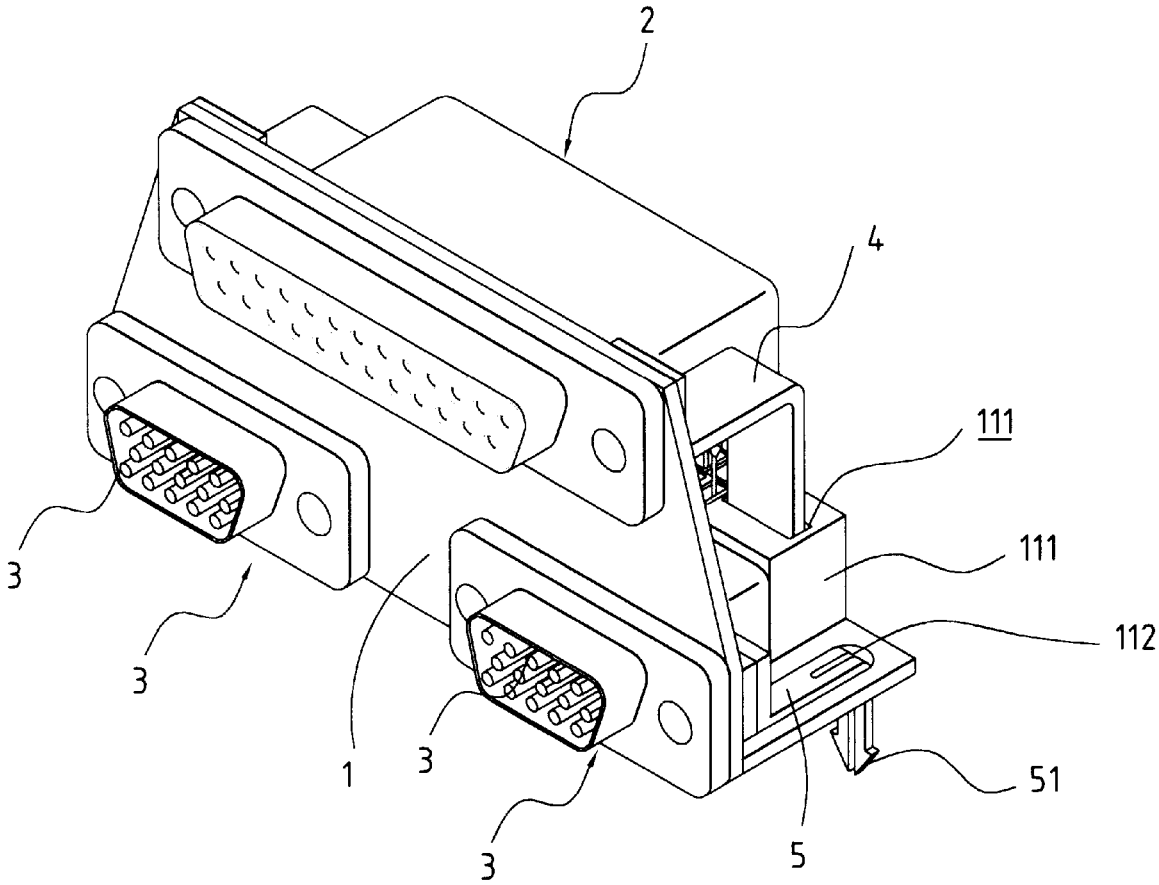
FIG. 4 is a side plane view of a further embodiment in the present invention.
Figure 5:
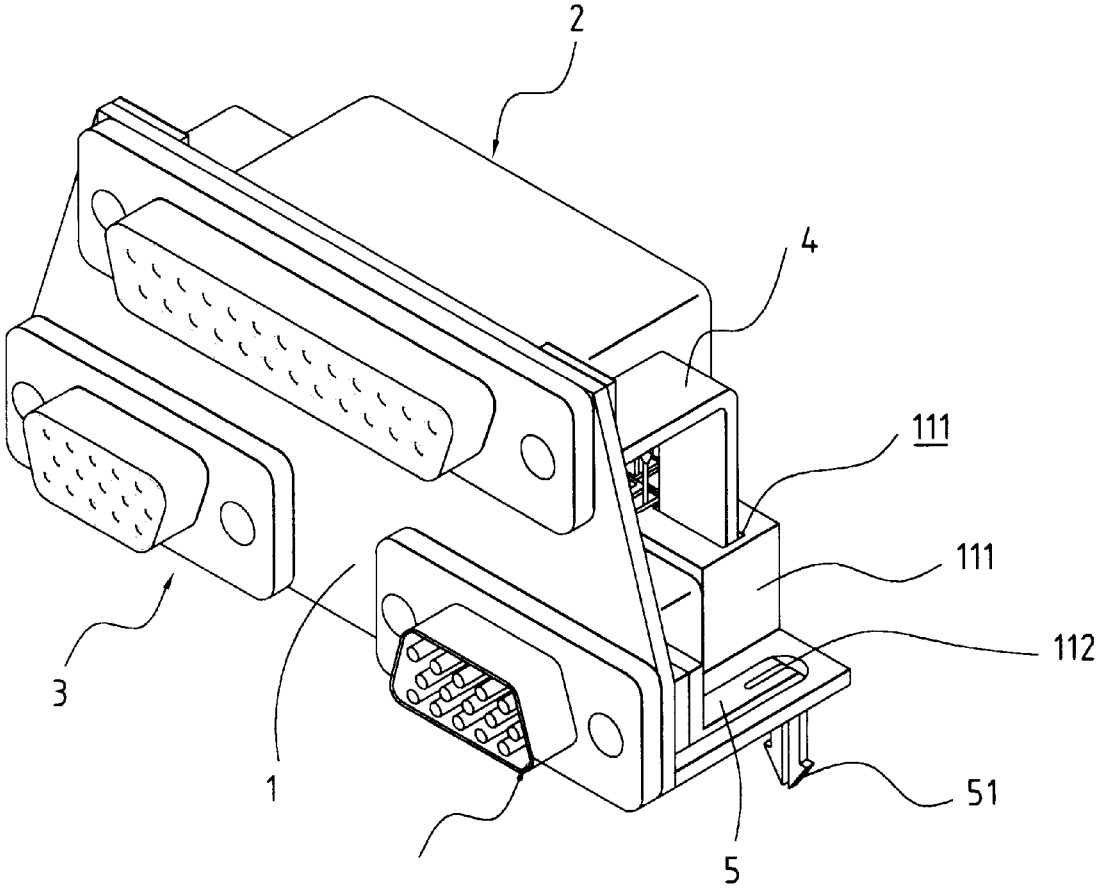
FIG. 5 is a side plane view of another embodiment in the present invention.
Figure 6:
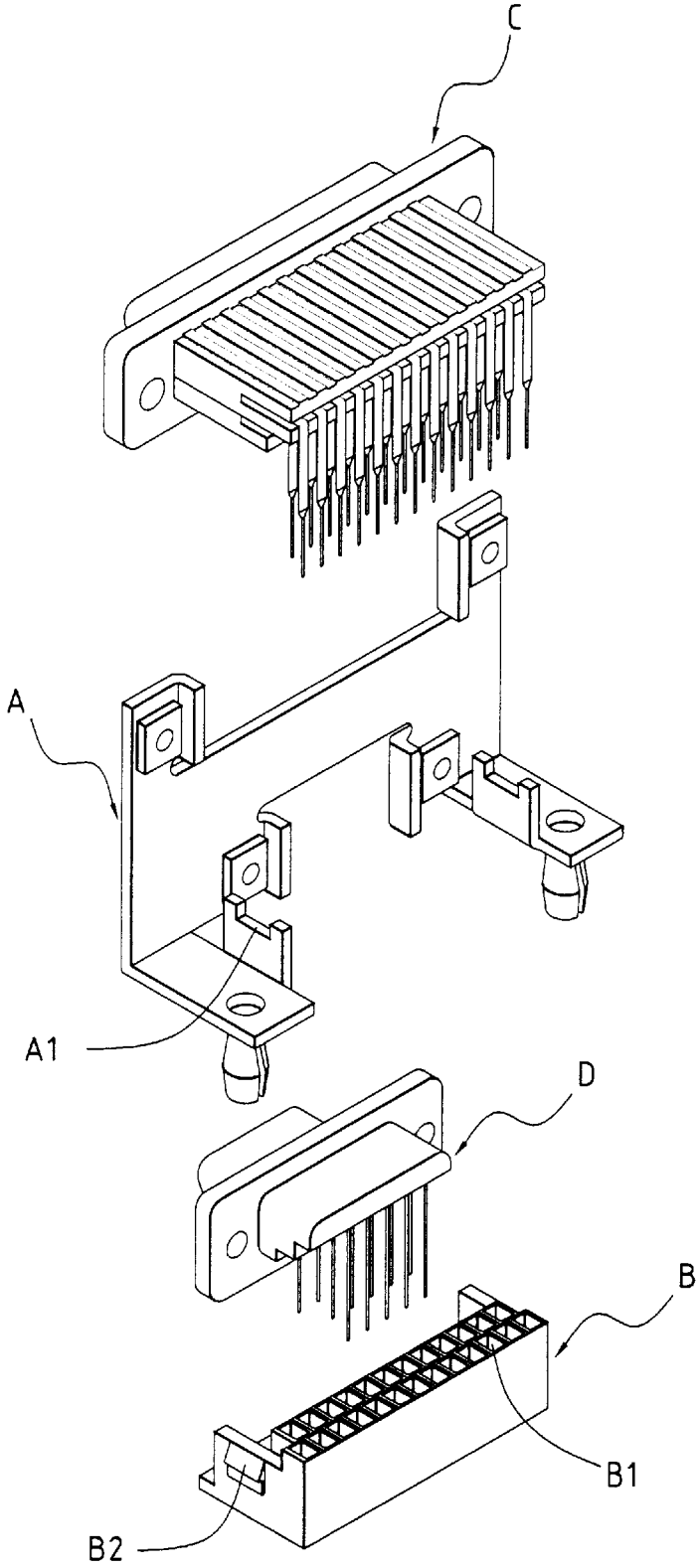
FIG 6 PRIOR ART
FIG. 6 is an exploded perspective view of a prior art electric connector set.

FIG. 3 is a perspective view of the present invention, although it is shown that the first and second connectors are female connectors with holes in the front plane, the connector may has other assembly such as those shown in FIG. 4 and 5. In FIGS. 4, the first connector 2 is a female connector, while the second connectors 3 are male connectors with pins in the front plane. In FIG. 5, the first connector 2 is a female connector, while the second connector 3 in the left side is a female connector and the second connector 3 in the right side is a male connector. Further, the orientations of the casings of the second and third connectors can be changed. As shown in FIG. 5, the right second connector 3 is reversed as is compared to that of the left second connector 3. All these conditions match with the aforementioned constructions, thus, all these combinations are within the scopes of the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An electric connector set comprising a frame body, a first connector, and two second connectors, the frame body being integrally formed by a vertical plate and a horizontal plate so as to have a L shape, an inserting base with a plurality of terminal inserting holes being located on the horizontal plate, the first connector having a plurality of terminal pins, wherein after the first connector is installed on the vertical plate of the frame body, the terminal pins will be inserted into the inserting holes of the inserting base, the second connectors also having a plurality of terminal pins and being installed on the horizontal plate of the frame body, wherein which are connected with each other, and the first and second connectors are combined integrally on the horizontal plate, the vertical plate has connector mounting holes, the connector mounting holes being used to mount the second connectors.

2. The electric connector set as recited in claim 1, wherein independent first elastic bent pieces and second elastic bent pieces are further provided, first and the second elastic bent pieces and are bent as an "ㄴ" shape the upper vertical portions of the first and the second elastic bent pieces have respective through holes, and the frame body is formed with respective through holes so that the first elastic bent pieces are used to fix the first connector to the frame body, and the second elastic bent pieces are used to fix the second connectors to the frame body.

3. The electric connector set as recited in claim 1, wherein the first connector is a female connector, and the second connectors are female connectors.

4. The electric connector set as recited in claim 1, wherein the first connector is a male connector, and the second connectors are male connectors.

5. The electric connector set as recited in claim 1, wherein the first connector is a female connector, and one of the second connectors is a male connector, while the other one of the second connector is a female connector.

6. The electric connector set as recited in claim 1, wherein the first connector is a male connector, and one of the second connectors is a male connector, while the other one of the second connector is a female connector.

* * * * *